United States Patent [19]

Mochizuki et al.

[11] Patent Number: 4,987,457

[45] Date of Patent: Jan. 22, 1991

[54] FIXING METHOD FOR A WET PROCESS COPIER

[75] Inventors: Manabu Mochizuki, Yokohama; Tsuneo Kurotori; Ichiro Tsuruoka, both of Tokyo; Katsuhiro Echigo, Yokohama; Hiroaki Takenouchi; Setsuo Soga, both of Tokyo, all of Japan

[73] Assignee: Ricoh Company, Ltd., Tokyo, Japan

[21] Appl. No.: 460,628

[22] Filed: Jan. 3, 1990

[30] Foreign Application Priority Data

| | | | |
|---|---|---|---|
| Jan. 12, 1989 | [JP] | Japan | 1-5509 |
| Feb. 8, 1989 | [JP] | Japan | 1-29239 |
| Feb. 8, 1989 | [JP] | Japan | 1-29240 |
| Nov. 29, 1989 | [JP] | Japan | 1-309738 |

[51] Int. Cl.[5] ..... G03G 15/20

[52] U.S. Cl. ..... 355/285; 355/286; 219/216; 432/60

[58] Field of Search ..... 355/282, 285, 286, 288, 355/295; 219/216, 388; 432/60

[56] References Cited

U.S. PATENT DOCUMENTS

| | | | |
|---|---|---|---|
| 4,842,944 | 6/1989 | Kuge et al. | 355/285 X |
| 4,910,559 | 3/1990 | Kuge et al. | 355/285 |

*Primary Examiner*—R. L. Moses

*Attorney, Agent, or Firm*—Oblon, Spivak, McClelland, Maier & Neustadt

[57] ABSTRACT

A fixing method for a wet process copier which develops an electrostatic latent image by using a heat-bridging type toner, transfers the resulting toner image to a paper sheet, and fixes the toner image transferred on the paper sheet by transporting the paper sheet through a nipping section defined by a heating roller and a pressing roller such that the side of the paper sheet carrying the toner image directly contacts the heating roller. At least a surface portion of the heating roller is made of either one of monomeric, additive-free RTV (Room Temperature Vulcanized) and LTV (Low Temperature Vulcanized) silicone rubbers. The heating roller has average surface roughness of less than 3 microns.

5 Claims, 6 Drawing Sheets

FIXING METHOD FOR A WET PROCESS COPIER

BACKGROUND OF THE INVENTION

The present invention generally relates to a wet process copier which electrostatically forms a latent image on a photoconductive element or similar image carrier and develops it by using a developer liquid composed of a carrier liquid and toner particles and, more particularly, to a method of fixing the developed image or toner image by heat.

In an electrophtographic copier, facsimile machine, printer or similar image forming apparatus, a latent image associated with image information is electrostatically formed on the surface of a photoconductive element which is a specific form of an image carrier. The latent image is developed by a developer liquid which is composed of a carrier liquid and toner particles dispersed in the carrier liquid. The developed image or toner image is transferred to a paper sheet or similar recording medium by electrophoresis and then fixed thereon by heat at a fixing station. Such a wet process uses toner particles the size of which is far smaller than toner particles used for a dry process. Specifically, the wet process is implemented by toner particles whose size is about 1 micron, while the dry process is implemented by toner particles whose size is about 10 microns. For this reason, the wet process is excellent in resolution and toner transparency and, therefore, produces clear-cut images. A fixing device for fixing the toner image as stated above has a heating roller in which a heater is accommodated, and a pressing roller which is pressed against the heating roller. While the paper sheet is transported through a nipping secion which is defined between the two rollers, the toner image on the paper sheet is heated under a predetermined pressure and thereby fixed on the paper sheet. The heating roller is often implemented by RTV (Room Temperature Vulcanized) silicone rubber or LTV (Low Temperature Vulcanized) silicone rubber.

On the other hand, in a fixing device for fixing a toner image produced by the dry process, a heating roller has to be durable and heat-resistant due to inherent operating conditions of the device, especially pressure and temperature. This kind of heating roller is, therefore, made of RTV or LTV silicone rubber to which is added a reinforcing agent or a filler such as silica or titanium dioxide ($TiO_2$) or an antioxidant such as red oxide. The heating roller using such a mixture of rubber and additive, however, has poor separability and cannot be applied to the wet process fixing device which fixes a wet toner image. Specifically, a wet toner image contains about 70 weight percent to 80 weight percent of carrier liquid (Isopar) having small surface energy and is melted by heat with the toner particles and carrier liquid being mixed together. The separability of the heating roller and toner is especially low for such a reason. The heating roller made of additive-containing rubber and applied to the wet process is apt to cause a so-called offset phenomenon to occur.

To eliminate the offset phenomenon, a fixing system using a heat-bridging type toner has already been proposed, as disclosed in Japanese Patent Application No. 62-139426 by way of example. A heat-bridging type toner has an improved fluidity-to-temperature characteristic over ordinary toners and is an attempt to improve the fixing ability of the device. However, the heat-bridging type toner brings about a problem that microscopically the toner runs or spreads along the fibers of paper at the boundary between an image area where it is present and a background area where it is absent, depending on the kind of paper. A series of experiments showed that such a run or spread of toner along the fibers of paper is ascribable to the fact that the toner layer on a paper sheet is abruptly heated when nipped by the heating roller and pressing roller. Specifically, as the toner layer is abruptly heated, a mixture of toner components (pigment and resin) and a solvent (Isopar) forming the toner layer boils with the result that the toner whose viscosity has been lowered spreads along the fibers of paper. The lower the smoothness and the tightness of the paper, the more the spread of toner is aggravated.

Some different approaches may be contemplated to eliminate the spread of toner stated above, as follows:

(1) To lower the temperature of the heating roller;

(2) To reduce the pressure acting between the heating and pressing rollers;

(3) To reduce the concentration of Isopar in the toner layer to thereby raise the melting point of toner; and (4) To change the surface condition of the heating roller.

All the approaches mentioned above are not fully satisfactory, as determined by experiments. Specifically, the approach (1) degrades the fixing ability as to smearing and evenness of solid images. The approach (2) is also detrimental to the evenness of solid images even if a paper sheet having low smoothness is used. The approach (3) may be implemented by a blotter roller as already proposed, but a fixing device with such an implementation is complicated in construction. The approach (4) produces a undesirable pattern on the surface when a halftone image is reproduced.

The prior art fixing system using the heat-bridging type toner is not capable of reducing the offset phenomenon to a level having sufficient margins. We studied the offset phenomenon in varies ways and found that it greatly depends on the physical property (melting point) of toner derived from the fluidity characteristic. Specifically, although the melting point and other physical properties of a toner contained in a developer liquid is, of course, correlated with those of a dry developer, the solvent forming a wet toner image together with the toner as stated earlier serves to prevent the toner from depositing on the heating roller. It follows that the offset rarely occurs in a low temperature range of the heating roller, i.e., a so-called cold offset is hardly observed in such a range. However, as the temperature of the heating roller shifts to a high temperature range, a hot offset occurs due to the influence of the melting point of the toner layer. Presumably, the hot offset is ascribable to the viscosity of the toner layer and the physical depositing property of the toner layer on the heating roller.

SUMMARY OF THE INVENTION

It is therefore an object of the present invention to provide a fixing method for a wet process copier which produces a high quality fixed image.

It is another object of the present invention to provide a fixing method for a wet process copier which insures separability high enough to prevent a toner from depositing on a heating roller without effecting the durability and heat resistance of the roller.

It is another object of the present invention to provide a generally improved fixing method for a wet process copier.

In accordance with the present invention, in a fixing method for a wet process copier which develops an electrostatic latent image by using a heat-bridging type toner to produce a toner image, transfers the toner image to a paper sheet, and fixes the toner image transferred to the paper sheet by transporting the paper sheet through a nipping section defined by a heating roller and a pressing roller such that one side of the paper sheet carrying the toner image directly contacts the heating roller, fixing energy Q (cal/cm$^2$) for fixing the toner image lies in a predetermined range expressed as:

$$Q = KT\sqrt{\frac{l}{V}}$$

where K is a constant, T is a temperature T (°C.) of the heating roller, l is a width (mm) of the nipping width, and V is a linar velocity (mm/sec).

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
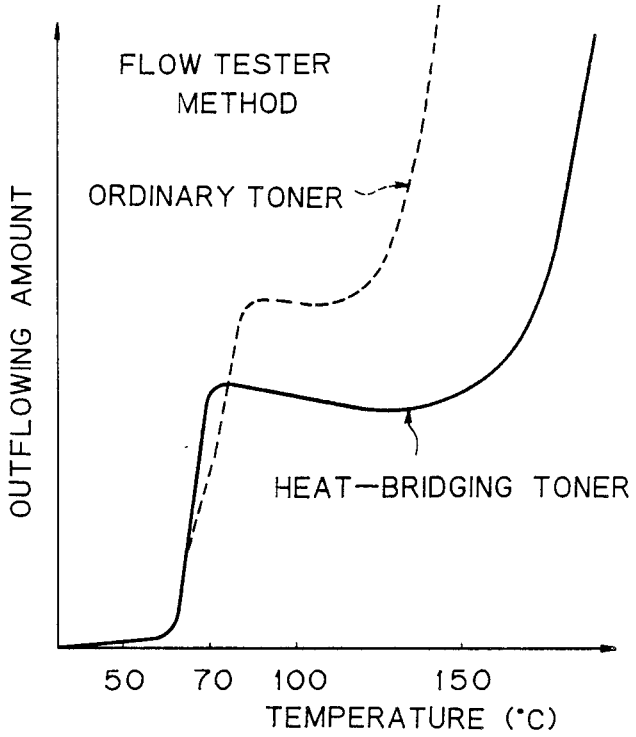
FIG. 1 is a graph showing the fluidity-to-temperature characteristic of an ordinary toner and that of a heat-bridging type toner.

Regarding a heating roller for fixing a toner image produced by a wet process, separability of the roller and toner is low, as discussed earlier. Especially, when the roller is made of additive-containing rubber, an offset is apt to occur. To eliminate the offset problem, a prior art fixing device for fixing a wet toner image uses a heat-bridging type toner. As shown in FIG. 1, this type of toner is different from an ordinary toner with respect to the fluidity-to-temperature characteristic and is successful in reducing the offset to a certain extent. However, in a prior art wet process copier implemented by the heat-bridging type toner, a fixing device causes the toner to run or spread along the fibers of paper depending on the kind of paper sheets used and is not capable of fully eliminating the offset.

Figure 2:
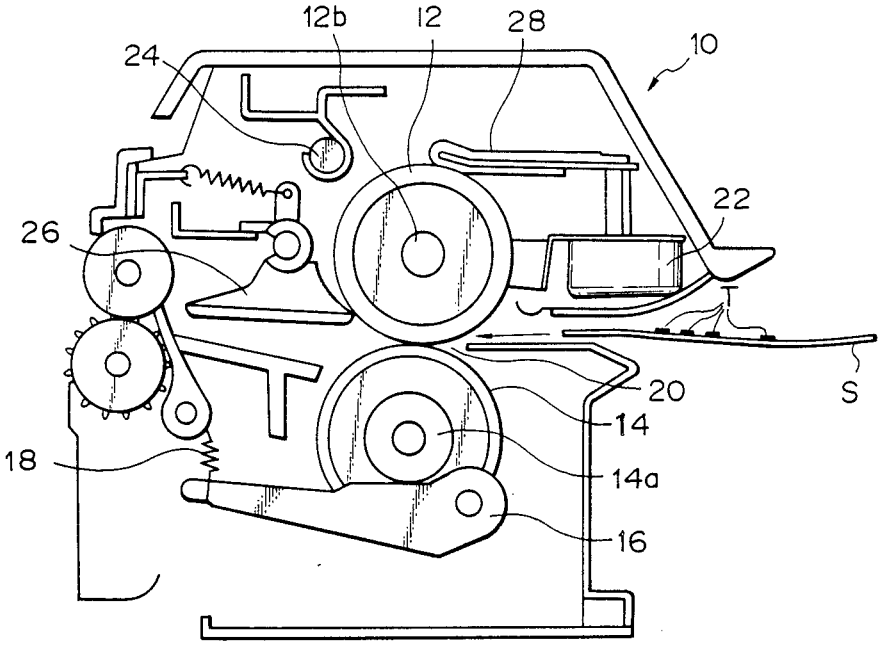
FIG. 2 is a vertical section of a fixing device for practicing the fixing method of the present invention.

Referring to FIG. 2, a fixing device for a wet process copier for practicing the present invention is shown and generally designated by the reference numeral 10. As shown, the fixing device 10 has a heating roller 12 and a pressing roller 14 which are pressed against each other with the intermediary of a path along which a paper sheet S is to be transported. The pressing roller 14 comprises a silicone rubber roller which is coated with fluoric resin, and it is mounted on a shaft 14*a*. A cam 16 has a cam surface which is pressed against the shaft 14*a* by the preload of a spring 18. The presser of the cam 16 acting on the pressing roller 14 is selected to be 22 kg f/cm as measured at opposite ends of the roller 14. The rollers 12 and 14 define a nipping section 20 therebetween over a predetermined width. The nipping section 20 guarantees a period of time necessary for fixing heat to be applied to the paper sheet S and a toner image T carried on the paper sheet S. In this particular embodiment, the nipping width is 5.5 millimeters.

Figure 3:
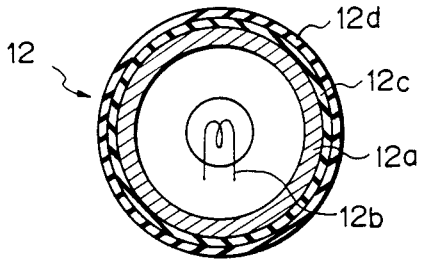
FIG. 3 is a section showing a specific construction of a heating roller which is included in the device of FIG. 2.

As best shown in FIG. 3, the heating roller 12 has a hollow cylindrical core 12*a* which is made of metal, and a 100 volts, 750 watts heater 12*b* accommodated in the core 12*a*. The heater 12*b* serves as a heat source for fixing the toner image T on the paper sheet S. A silicone rubber layer 12*c* is provided on the outer periphery of the core 12*a* to provide the latter with elasticity. The silicone rubber layer 12*c* is 300 microns thick and is provided with a 50 microns thick separating layer 12*d* thereon. The separating layer 12*d* is implemented by monomeric RTV or LTV silicone rubber free from additives.

Referring again to FIG. 2, a thermistor 22 and a temperature fuse 24 are associated with the heater 12*b* so as to control the temperature of the heating roller 12. A heating pawl 26 and a webbing of felt 28 are pressed against the outer periphery of the heating roller 12. The felt 28 constantly applies separating oil to the surface of the heating roller 28. In this embodiment, the separating oil comprises Silicone Oil KF-96 available from Shinetsu Silicone. The paper sheet S is transported from the right to the left as viewed in FIG. 2 with its side carrying the toner image T facing upward. Hence, the toner image T is directly brought into contact with the heating roller 12 having the heater 12*b* thereinside.

A developer liquid used with the fixing device 10 is produced by diluting a heat-bridging type toner with Isopar H by a ratio of 50 grams per litter. The fixing device 10 was installed in a copier CT-5085 available from Ricoh and operated to fix a toner image. The fixing energy Q (cal/cm$^2$) is expressed as:

$$A = KT\sqrt{\frac{l}{V}}$$

where K is a constant, T is the temperature of the heating roller 12 (°C.), l is the nipping width (mm), and V is the linear velocity (mm/sec).

The other conditions selected are that the toner has a heat acquisition degree of 0.0207, that the heating roller 12 has a heat acquisition degree of 0.01307, and that the toner has a temperature of 25° C.

Table 1 shown below lists the ranks of smear and toner spread determined at the linear velocity of 266 mm/sec and at various temperatures. In Table 1, the smear is representative of fixing ability obtained with paper sheets whose smoothness is 110 sec to 150 sec (T-6200 available from Ricoh), while the toner spread is representative of fixing ability obtained with rug paper (Gilbert bond containing 25% of cotton).

TABLE 1

| HEAT ROLLER 12 | SMEAR (RANK) | TONER SPREAD (RANK) | FIXING ENERGY (cal/cm$^2$) |
|---|---|---|---|
| 80 | 1 | 5 | 0.0715 |
| 90 | 1 | 5 | 0.0845 |
| 100 | 1.5 | 5 | 0.0975 |
| 110 | 1.5 | 5 | 0.1105 |
| 120 | 2.5 | 5 | 0.1235 |
| 130 | 3 | 5 | 0.1365 |
| 140 | 4 | 5 | 0.1495 |
| 150 | 5 | 5 | 0.1625 |
| 160 | 5 | 4.5 | 0.1755 |
| 170 | 5 | 4 | 0.1885 |
| 180 | 5 | 3 | 0.2015 |
| 190 | 5 | 1.5 | 0.2145 |
| 200 | 5 | 1 | 0.2275 |

In Table 1, the numerals 1 to 5 indicate the ranks. Concerning the smear, at the rank 1, an image comes off when lightly rubbed by hand. At the rank 2, a smear occurs when an image is lightly rubbed by hand. At the rank 3, some smear occurs when an image is rubbed by hand moderately. At the rank 4, no smear occurs when an image is rubbed by hand moderately. At the rank 5, no smear occurs when an image is rubbed strongly by hand. The toner spread ranks were derived from lines the resolution chart of which was 4.5 lines /mm. Specifically, at the rank 1, the interline spacings of the resolution chart are filled up to render the resolution difficult. At the rank 2, although the interline spacings of the resolution chart are filled up, resolution is not impossible. At the rank 3, some traces of toner spread are observed between the lines of the resolution chart. At the rank 5, the interline spacings of the resolution chart are clear-cut and free from traces of toner spread.

To determine the smear ranks, use was made of paper sheets having smoothness of 110 sec to 150 sec as stated previously because smear and smoothness are correlated with each other, i.e., smear is more likely to occur as the smoothness increases. Toner spread and smoothness are also correlated with each other, i.e., toner spread is easy to occur on rug paper.

Figure 4:
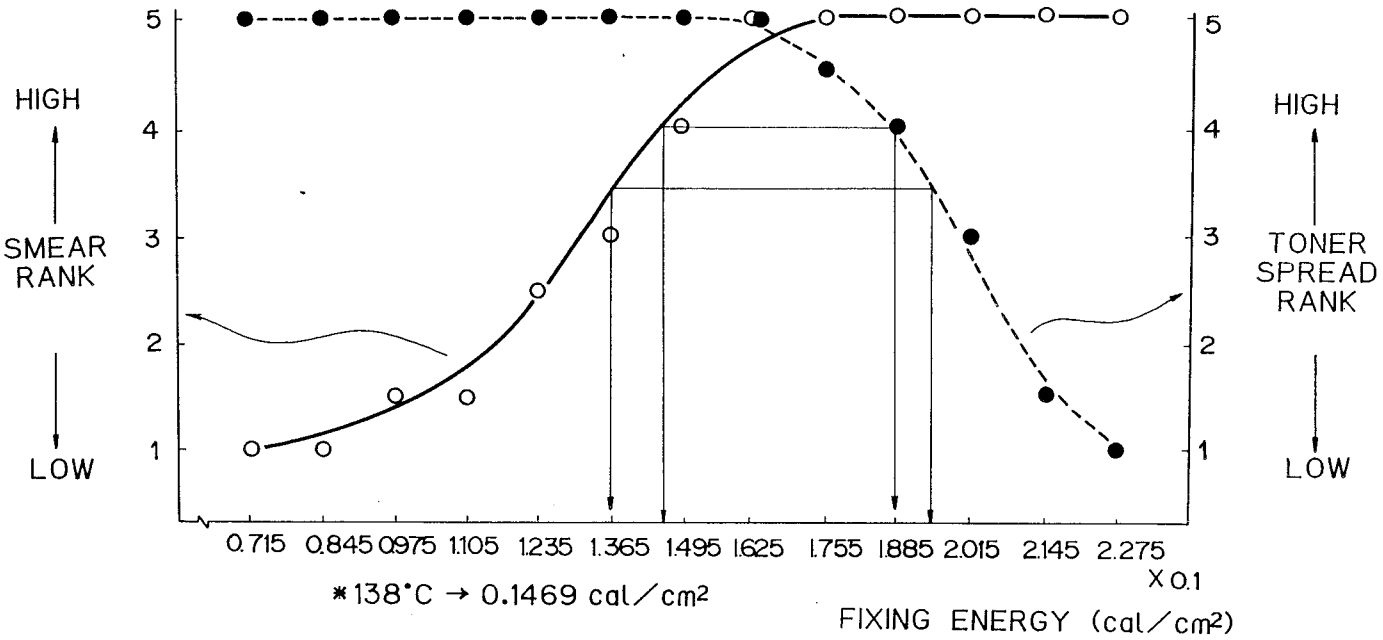
FIG. 4 is a graph representative of a relationship between the fixing energy Q and the smear rank and toner spread rank.

Fixing energy Q is also determined as shown in Table 1. FIG. 4 indicates the relationship between the fixing energy Q and the smear rank and toner spread rank. As shown, assuming that the smear rank and toner spread ranks of 3.5 are acceptable, the fixing energy Q ranges from 0.1365 to 0.1950 (cal/cm$^2$). Considering a more preferable range which is the rank 4 and higher rank, an image can be satisfactorily fixed when the fixing energy ranges from 0.1469 to 0.1885 (cal/cm$^2$).

Concerning linear velocities other than 266 mm/sec, it will be seen that ideal fixing is also achievable by selecting the conditions such that the fixing energy Q remains in the range of 0.1469 to 0.1885 (cal/cm$^2$).

The temperature T of the heating roller 12 can be lowered to a significant degree by applying common values such as linear velocity to the various conditions which are determined by the above equation on the basis of the fixing energy Q. Under such a low operating condition, the illustrative embodiment implements the surface of the heating roller 12 by monomeric, additive-free RTV or LTV silicone rubber.

A wet toner image and a dry toner image fixing processes available with the fixing device 10 are different from each other in the following respects, as determined by experiments.

(1) Cold offsets inherent in the fixation of a dry toner image do not occur in the fixation of a wet toner image. This is because dry toner particles do not have a coupling force until they have been melted by heat while wet toner particles is cohesive.

(2) An air layer does not exist in a wet toner image and between the wet toner image and a paper sheet. Hence, far higher heat conductivity is achievable than with the dry process.

(3) A wet toner image is soft and makes sufficiently close contact with the heating roller when subjected to a force as small as about two-thirds of the force particular to the dry process.

(4) The wet toner has a low melting point. This, coupled with the fact that the amount of toner forming a toner image is about one-tenth of the amount necessary for a dry toner image, allows the use of a roller temperature as low as about 140° C. which is contrastive to about 185° C. particular to the dry process. More specifically, since a wet toner image is the mixture of a toner and a carrier liquid (Isopar), the actual melting temperature of the wet toner image is much lower than that of a resin itself which constitutes the toner.

From the characteristics of a wet toner described above, it will be seen that a fixing device for fixing a wet toner image is operable under the following conditions:

(i) The operating temperature is low; and (ii) A lower pressure can be selected.

In the light of the above, the heating roller 12 of the fixing device 10 is provided with the separating layer **12*d* implemented by monomeric, additive-free RTV or LTV silicone rubber. The rubber constituting the roller 12, therefore, does not contain any additive which would degrade separability. This provides the roller 12 with high separability and thereby eliminates the offset problem. Further, since the temperature of the roller 12 can be lowered by far on the basis of the fixing energy Q and since the fixing device 10 is operable at a relatively low temperature and with a relatively low pressure, the roller 12** of the illustrative embodiment has sufficient durability and heat resistance despite that it does not contain an additive.

Figure 5:
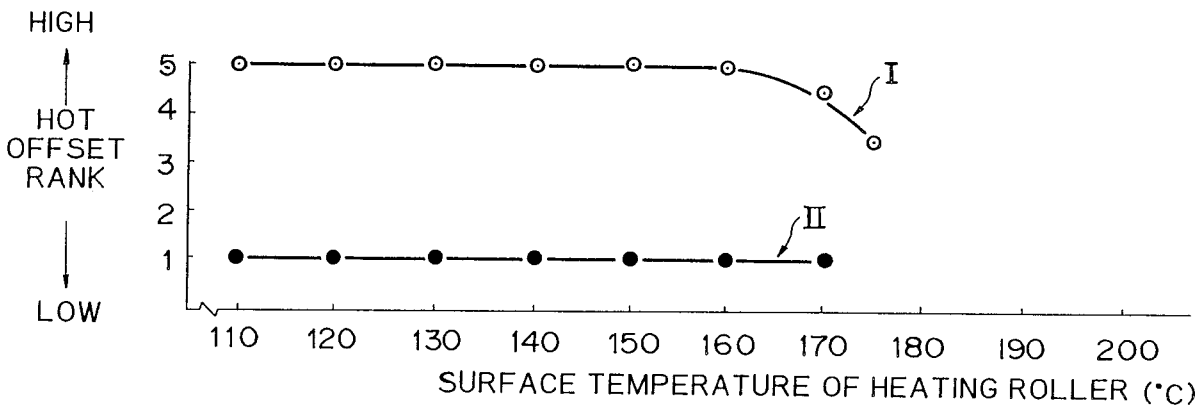
FIGS. 5 and 6 are graphs showing offsets caused by various kinds of heating rollers and various kinds of toners.
Figure 6:
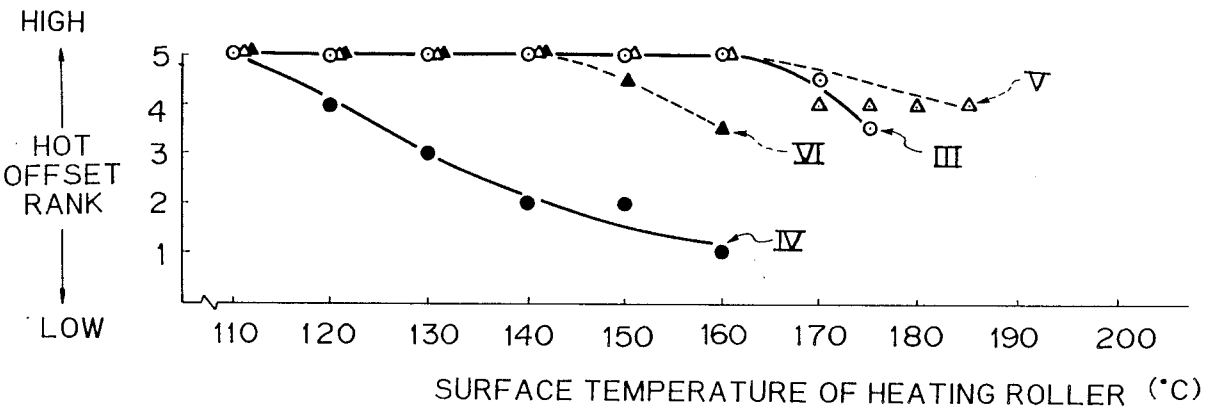

Referring to FIGS. 5 and 6, the above-mentioned improvement in the separability of the heating roller 12 is demonstrated in graphs. Specifically, FIG. 5 shows a curve I representative of offsets observed when the heating roller 12 implemented by monomeric RTV slicone rubber was operated with an ordinary wet toner, and a curve II representative of offsets occurred when it was operated with a heat-bridging type wet toner. In the figure, the ordinate indicates offset ranks 1 to 5. At the offset rank 5, no offset occurs; at the rank 4, and offset is observed through a loupe; at the rank 4, an offset is slightly visible; at the rank 2, an offset is clearly seen; and at the rank 1, an offset is clearly seen and greater than 0.4 in terms of ID. FIG. 6 shows a curve III representative of offsets particular to the heating roller 12 which was implemented by monomeric RTV silicone rubber and a curve IV representative of offsets particular to the roller 12 which was implemented by RTV silicone rubber containing an additive. FIG. 6 also shows a curve V representative of offsets particular to the heating roller 12 implemented by monomeric LTV silicone rubber and a curve VI representative of offsets particular to the roller 12 implemented by additive-containing LTV silicone rubber. Tests were conducted by selecting a linear velocity for fixation of 266 mm/sec, by using rug paper having smoothness of 5 sec and containing 25% of cotton, and by forming a black solid image of ID 1.9 over a 30 millimeters by 30 millimeters area. A paper sheet carrying such a solid image was transported through the fixing station and then transferred to a paper sheet.

Figure 7:
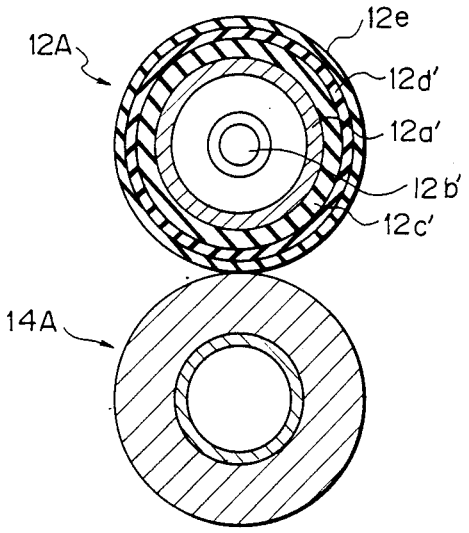
FIG. 7 is a section showing another specific construction of the heating roller.

Referring to FIG. 7, another specific construction of the pressing roller is shown. As shown, the pressing roller 14A comprises a silicone rubber roller and a coating of Teflon provided on the surface of the silicone rubber roller. Also shown in FIG. 7 is another specific construction of the heating roller 12A which coacts with the pressing roller 14A. The heating roller 12A has a metallic core 12'a in which a 100 volts, 750 watts heater 12'b is disposed to play the role of a heat source. A silicone rubber layer 12'c and an oil-resistant fluoric silicone rubber layer 12'd are deposited one upon the other on the outer periphery of the core 12'a in order to provide the latter with elasticity. A separating layer 12e having a predetermined thickness is provided on the outer periphery of the silicone rubber layer 12'd. The separating layer 12e is constituted by RTV or LTV silicone rubber and treated to have a surface whose average roughness is less than 3 microns. Such a surface may be implemented by adhesion, spraying, etc.

The developer liquid for forming a wet toner image on a paper sheet is comprised of a liquid developer containing a heat-bridging type toner which is produced by any one of methods heretofore proposed. In this particular embodiment, use is made of a developer liquid prepared by diluting a heat-bridging type toner with Isopar (available from Exxon) by a ratio of 50 grams per litter (i.e. at a ratio of 50 grams of condensed toner to 1 litter of Isopar). A wet process copier CT-5085 of Ricoh was operated with such a developer liquid and with a comparative developer liquid which was produced by a method taught in Japanese Patent Laid-Open Publication (Kokai) No. 62-236956 and adjusted by a ratio of 140 grams per litter (i.e. mixing 140 grams of condensed toner to 1 litter of Isoper). When paper sheets T-6200 of size A4 also available from Ricoh were used, a black solid toner layer was deposited thereon by 480 milligrams when the heat-bridging type toner was used and by 471 milligrams when the comparative toner was used. It is to be noted that the amount of toner so transferred to a paper sheet is the total weight (including a solvent.)

To test the illustrative embodiments of the present invention, two different kinds of heating rollers were implemented by RTV silicone rubber and LTV silicone rubber, respectively. The surfaces of such rollers were changed to roughnesses of 0.5, 1, 3 and 6. The individual heating rollers were used with the developer containing a heat-bridging type roller and the prior art toner. The results are shown in Table below.

TABLE 2

| KIND OF HEAT ROLLER | KIND OF TONER | AVERAGE SURFACE ROUGHNESS | HOT OFFSET RANK |
|---|---|---|---|
| RTV | HEAT-BRIDGING TYPE TONER | 0.5 | 5 |
| | | 1 | 5 |
| | | 3 | 5 |
| | | 6 | 4 |
| | ORDINARY TONER | 0.5 | 3 |
| | | 1 | 2 |
| | | 3 | 1 |
| | | 6 | 1 |
| LTV | HEAT-BRIDGING TYPE TONER | 0.5 | 5 |
| | | 1 | 4.5 |
| | | 3 | 3.5 |
| | | 6 | 2 |
| | ORDINARY TONER | 0.5 | 2 |
| | | 1 | 1 |
| | | 3 | 1 |
| | | 6 | 1 |

For the above tests, the fixing temperature was selected to be 150°±10 ° C, and the linear velocity for fixation was selected to be 266 mm/sec. Rug paper sheets containing 25% of cotton and having smoothness of 5 sec were used. A black solid image of ID 1.9 was formed on such a paper sheet over a 30 millimeters by 30 millimeters area, and then the paper sheet was transported through the fixing station. In Table 2, offset ranks 1 to 5 correspond in level to the offset ranks described previously with reference FIGS. 5 and 6.

Table 2 clearly indicates that combining the RTV heating roller and the heat-bridging type toner and making the average surface roughness of the roller smaller and smaller are effective to cope with hot offsets. When use was made of the paper sheets T-6200 of Ricoh having high smoothness, the hot offset rank 5 was achieved with the heat-bridging type toner and any one of the RTV and LTV heating rollers. Further, the RTV heating roller was combined with the heat-bridging type toner and provided with surface roughness of less than 3 microns. The temperature of such a heating roller was sequentially elevated from 110° C. to 200° C. by each 10° C. so as to measure hot offsets. The measured offsets belonged to the rank 5 at all the temperatures. Under the same conditions, 200 thousand paper sheets of size A4 were continuously transported in the laterally long position to form an image in an area of 10% on each paper sheet, and then the offset was measured in the same manner. The measured offset rank was also the rank 5 at all the temperatures.

Presumably, the hot offset phenomenon is ascribable to the physical deposition of a toner having been melted on a heating roller, as discussed earlier. The physical deposition of a toner on the heating roller is correlated with the surface condition of the roller. When the surface of the heating roller has smoothness higher than a predetermined value, the smooth surface lowers the physical depositing ability of the toner on the roller and thereby enhances separability. The hot offset is also effected by the melting point of a toner, as stated previously. Hence, combining a heat-bridging type toner having a lower melting point with a heating roller having improved separability as mentioned above is successful in preventing the deposition of a toner on a heating roller more positively. Thus, hot offsets hardly occur, the optimum rank 5 is insured at all times, and hardly any toner deposits on the cleaning pad. This is also true with yellow, magenta, and cyan toners, as confirmed by experiments.

In summary, in accordance with the present invention, a fixing operation is performed under particular conditions which confine fixing energy to a predetermined range. This realizes clear-cut fixed images on paper sheets while suppressing smears. In order to enhance the separability of a heating roller of a fixing device which fixes a wet toner image, at least a surface portion of the roller formed of monomeric, additive-free RTV or LTV silicon subber. The heating roller, therefore has sufficient durability and heat resistance and, yet, offsets, especially hot offsets, are effectively eliminated. Such a surface portion of the heating roller is treated to have average roughness of less than 3 microns in order to suppress the physical deposition of a toner on the roller and to thereby improve separability. This prevents a toner from depositing on the heating roller further effectively. Use is made of a developer liquid containing a heat-bridging type toner, i.e., a toner the fusion of which is suppressed. The combination of a heating roller having improved separability due to greater smoothness than a predetermined value and the toner whose fusion is suppressed constitutes an additional implementation for enhancing separability. This prevents the toner from depositing on the heating roller effectively and positively.

Various modifications will become possible for those skilled in the art after receiving the teachings of the present disclosure without departing from the scope thereof.

What is claimed is:

1. In a fixing method for a wet process copier which develops an electrostatic latent image by using a heat-bridging type toner to produce a toner image, transfers said toner image to a paper sheet, and fixes said toner image transferred to said paper sheet by transporting said paper sheet through a nipping section defined by a heating roller and a pressing roller such that one side of said paper sheet carrying said toner image directly contacts said heating roller, the improvement wherein fixing energy Q (cal/cm$^2$) for fixing said toner image lies in a predetermined range expressed as:

$$Q = KT\sqrt{\frac{l}{V}}$$

where K is a constant, T is a temperature T (°C.) of said heating roller, l is a width (mm) of said nipping width, and V is a linar velocity (mm/sec).

2. A method as claimed in claim 1, wherein said predetermined range of the fixing energy Q is 0.1365 cal/cm$^2$ to 0.1950 cal/cm$^2$.

3. A method as claimed in claim 2, wherein said predetermined range of the fixing energy Q is 0.1469 cal/cm$^2$ to 0.1885 cal/cm$^2$.

4. A method as claimed in claim 1, wherein at least a surface portion of said heating roller comprises either one of monomeric, additive-free RTV (Room Temperature Vulcanized) and LTV (Low Temperature Vulcanized) silicone rubbers.

5. A method as claimed in claim 4, wherein said heating roller has a surface having average roughness of less than 3 microns.

* * * * *